US008942598B2

(12) United States Patent
Hashimoto et al.

(10) Patent No.: US 8,942,598 B2
(45) Date of Patent: Jan. 27, 2015

(54) IMAGE FORMING APPARATUS AND ROTATING BODY UNIT

(75) Inventors: Junichi Hashimoto, Toyohashi (JP); Yohei Hashimoto, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 112 days.

(21) Appl. No.: 13/432,344

(22) Filed: Mar. 28, 2012

(65) Prior Publication Data

US 2012/0308265 A1 Dec. 6, 2012

(30) Foreign Application Priority Data

May 31, 2011 (JP) ..... 2011-122279

(51) Int. Cl.
*G03G 15/00* (2006.01)
*G03G 21/16* (2006.01)
*G03G 15/01* (2006.01)

(52) U.S. Cl.
CPC ..... *G03G 15/0194* (2013.01); *G03G 21/1671* (2013.01); *G03G 15/757* (2013.01); *G03G 21/1647* (2013.01)
USPC ..... 399/167

(58) Field of Classification Search
CPC ..... G03G 15/757; G03G 15/5008; G03G 21/186; G03G 21/1647; G03G 21/1857
USPC ..... 399/167
See application file for complete search history.

(56) References Cited

U.S. PATENT DOCUMENTS

| | | | | |
|---|---|---|---|---|
| 7,366,445 | B2 * | 4/2008 | Hoashi et al. | 399/167 |
| 2007/0253729 | A1 * | 11/2007 | Takagi | 399/117 |
| 2010/0272470 | A1 * | 10/2010 | Tomatsu et al. | 399/167 |
| 2010/0329757 | A1 | 12/2010 | Souda | |

FOREIGN PATENT DOCUMENTS

| | | |
|---|---|---|
| JP | 2011-013268 | 1/2011 |
| JP | 2011-075659 | 4/2011 |

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

In an image forming apparatus, a rotating body has a follower member that is arranged to confront a drive member in an axial direction of the drive member. A drive transmitting member transmits drive force from the drive member to the follower member by coupling the drive member and the follower member with each other, while allowing relative positional deviation between the drive member and the follower member on a plane perpendicular to the axial direction of the drive member within a prescribed range. The drive member and the follower member have a drive-member side contact part and a follower-member side contact part, respectively. A making-contact member brings the drive-member side contact part and the follower-member side contact part into contact with each other.

10 Claims, 10 Drawing Sheets

IMAGE FORMING APPARATUS AND ROTATING BODY UNIT

CROSS REFERENCE TO RELATED APPLICATION

This application claims priority from Japanese Patent Application No. 2011-122279 filed May 31, 2011. The entire content of this priority application is incorporated herein by reference.

TECHNICAL FIELD

The present invention relates to an image forming apparatus that uses an electrophotographic method, and a rotating body unit for being mounted in the image forming apparatus.

BACKGROUND

As a color printer of an electrophotographic type, a color laser printer including an apparatus main body and a process unit has been known. The process unit holds a plurality of photosensitive members and can be detachably attached to the apparatus main body.

A known example of such a color laser printer is one including a drive source, a main body drive gear, a coupling member, an Oldham member, and a drawer. The drive source is arranged on the apparatus main body. Driving force from the drive source is transmitted to the main body drive gear for rotation drive. The main body drive gear includes the coupling member. The coupling member includes the Oldham member. The drawer supports a photosensitive drum which has a coupling female member on one end.

In the above-described color laser printer, when forming an image, the coupling member is urged by a coil spring and advances toward the coupling female member so that the Oldham member and the coupling female member are engaged with each other. As a result, the coupling member, the Oldham member, and the coupling female member form an Oldham coupling, whereby the main body drive gear and the photosensitive drum are connected and driving force is transmitted to the photosensitive drum.

SUMMARY

In the foregoing color laser printer, when the coupling member is advanced toward the coupling female member, the Oldham member is sandwiched between and makes contact with both the coupling member and the coupling female member.

Frictional forces from the coupling member and the coupling female member can thus hinder movement of the Oldham member. In such a case, a deviation of the center of rotation of the photosensitive drum (coupling female member) may fail to be favorably allowed in a plane perpendicular to the axial direction of the main body drive gear.

In view of the foregoing, an object of the present invention is to provide an image forming apparatus and a rotating body unit that can transmit driving force to a rotating body while favorably allowing a deviation between the centers of rotation of a drive member and the rotating body when the drive member and the rotating body are connected to each other.

In order to attain the above and other objects, the invention provides an image forming apparatus, including: a drive source; a drive member; a rotating body; a making-contact member; and a drive transmitting member. The drive source is configured to generate drive force. The drive member is configured to receive drive force transmitted from the drive source and to be driven to rotate upon receiving the drive force. The rotating body has a follower member, the follower member being arranged to confront the drive member in an axial direction of the drive member. The making-contact member is configured to bring the drive member and the follower member into contact with each other. The drive transmitting member is configured to transmit drive force from the drive member to the follower member by coupling the drive member and the follower member with each other, while allowing relative positional deviation between the drive member and the follower member on a plane perpendicular to the axial direction of the drive member within a prescribed range, the drive member and the follower member having a drive-member side contact part and a follower-member side contact part, respectively, the making-contact member bringing the drive-member side contact part and the follower-member side contact part into contact with each other.

According to another aspect, the present invention provides a rotating body unit for being mounted in an apparatus main body, the apparatus main body being provided with a drive source that is configured to generate drive force and a drive member that is configured to receive drive force transmitted from the drive source and to be driven to rotate upon receiving the drive force. The rotating body unit includes; a rotating body; and a drive transmitting member. The rotating body has a follower member, the follower member being arranged to confront the drive member in an axial direction of the drive member if the rotating body unit is mounted in the apparatus main body. The drive transmitting member is configured to transmit drive force from the drive member to the follower member by coupling the drive member and the follower member with each other, while allowing relative positional deviation between the drive member and the follower member on a plane perpendicular to the axial direction of the drive member within a prescribed range. The follower member has a follower-member side contact part that is configured to be brought into contact with a drive-member side contact part that is provided in the drive member, the follower-member side contact part being brought into contact with the drive-member side contact part by a making-contact member that is provided in the apparatus main body.

BRIEF DESCRIPTION OF THE DRAWINGS

The particular features and advantages of the invention as well as other objects will become apparent from the following description taken in connection with the accompanying drawings, in which:

FIGS. 7 and 8 are front views illustrating how to position the process unit relative to a main casing, wherein FIG. 7 shows the state where the drive member is in a retracted position and FIG. 8 shows the state where the drive member is in an advanced position;

DETAILED DESCRIPTION

Next, embodiments of the present invention will be described while referring to the accompanying drawings.

1. Entire Structure of Color Printer

Figure 1:
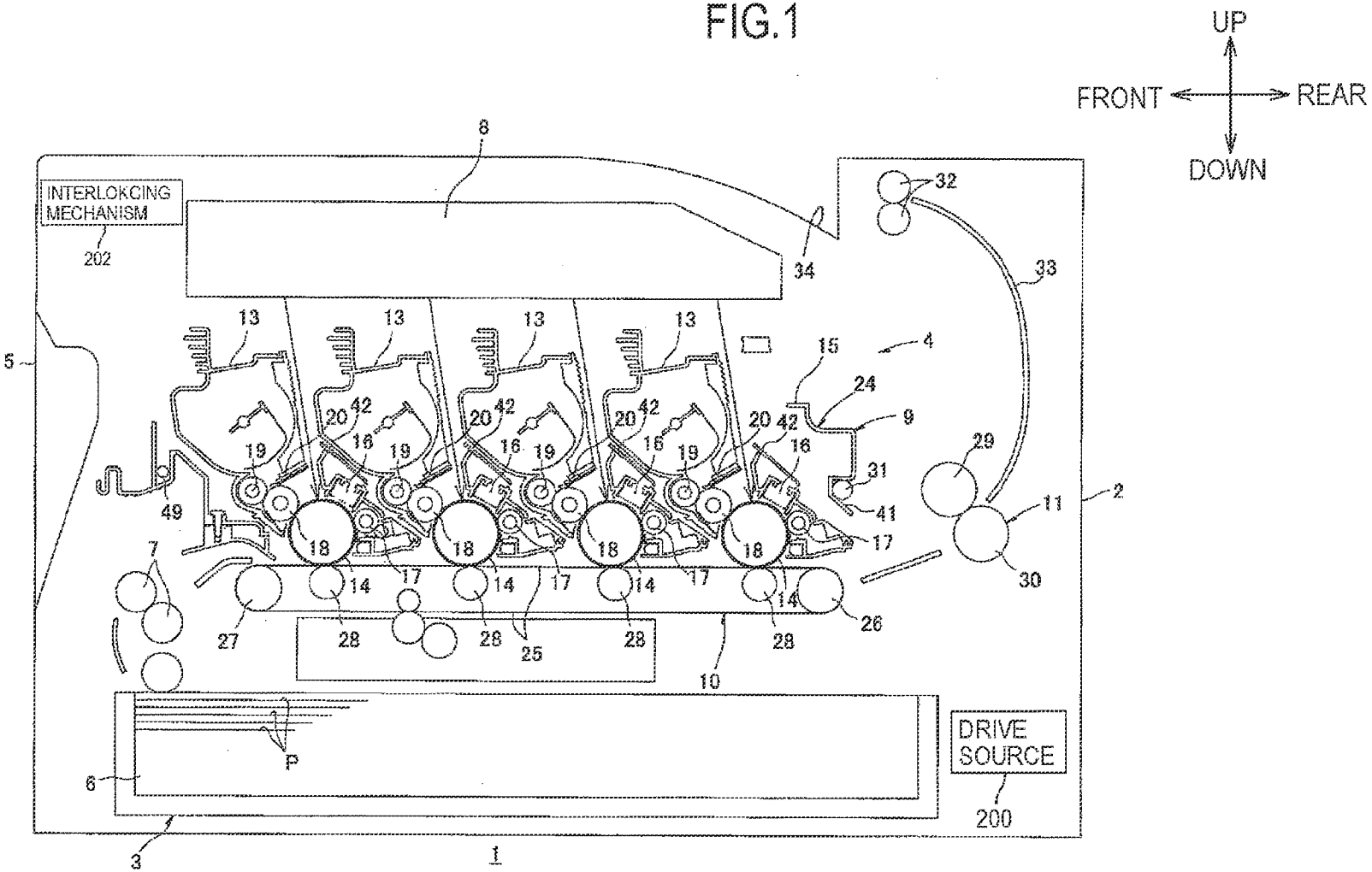
FIG. 1 is a cross-sectional side view of a color laser printer according to a first embodiment of the present invention.

As shown in FIG. 1, a color laser printer 1 according to an embodiment of the present invention is a direct tandem color printer of a horizontal type.

The terms "upward", "downward", "upper", "lower", "above", "below", "beneath", "right", "left", "front", "rear" and the like will be used throughout the description assuming that the color laser printer 1 is disposed in an orientation in which it is intended to be used. In use, the color laser printer 1 is disposed as shown in FIG. 1.

The color laser printer 1 includes a main casing 2, a feeding unit 3 for feeding papers P, and an image-forming unit 4 for forming images on the papers P.

(1) Main Casing

The main casing 2 is a box having a rectangular shape in a side view for accommodating the feeding unit 3 and the image-forming unit 4. A front cover 5 is provided on one side surface of the main casing 2 for allowing a process unit 9 (to be described later) to be mounted in and detached from the main casing 2. The front cover 5 is pivotably openable about a bottom portion thereof.

In the following description, the side of the main casing 2 on which the front cover 5 is provided (the left side in FIG. 1) will be referred to as the "front side," while the opposite side (the right side in FIG. 1) will be referred to as the "rear side." The left and right sides of the main casing 2 will be based on the perspective of a user facing the front side of the color laser printer 1.

(2) Feeding Unit

A sheet tray 6 for accommodating papers P is detachably mounted in a bottom section of the main casing 2.

The papers P accommodated in the sheet tray 6 are fed toward between a pair of registration rollers 7 positioned at an upper-front section of the sheet tray 6 one by one, and are sequentially conveyed toward the image-forming unit 4 (more specifically, positions between photosensitive drums 14 (described later) and a conveying belt 25 (described later)) at a predetermined timing.

(3) Image-forming Unit

The image-forming unit 4 includes a scanner unit 8, the process unit 9, a transfer unit 10, and a fixing unit 11.

(3-1) Scanner Unit

The scanner unit 8 is disposed in an upper section of the main casing 2. As indicated by solid lines in FIG. 1, the scanner unit 8 irradiates four laser beams toward four photosensitive drums 14 (described later) to expose the four photosensitive drums 14 based on image data.

(3-2) Process Unit (3-2-1) Structure of Process Unit

The process unit 9 is disposed below the scanner unit 8 and above the transfer unit 10, and includes a drum unit 24 and four developing units 13.

The drum unit 24 includes a process frame 15, the four photosensitive drums 14, four Scorotron chargers 16 and four drum cleaning rollers 17. The process frame 15 is a frame of a rectangular shape in a plan view that is elongated in the front-to-rear direction. The process frame 15 is detachably mounted in the main casing 2 and is capable of being pulled out of the main casing 2 in the front-to-rear direction (see FIG. 2). The photosensitive drums 14, Scorotron chargers 16, and drum cleaning rollers 17 are supported by the process frame 15.

Each photosensitive drum 14 has a circular cylindrical shape extending in the left-to-right direction. The four photosensitive drums 14 are juxtaposed with one another and are arranged in the front-to-rear direction as being spaced apart from one another at prescribed intervals. The four photosensitive drums 14 correspond to four colors of black, yellow, magenta, and cyan, respectively.

Each Scorotron charger 16 is disposed at the upper-rear side of the corresponding photosensitive drum 14 and is spaced away from the corresponding photosensitive drum 14 at a predetermined interval.

Each drum cleaning roller 17 is disposed at a rear side of the corresponding photosensitive drum 14 and contacts the corresponding photosensitive drum 14.

The developing units 13 are disposed in one to one correspondence with the photosensitive drums 14. Each developing unit 13 is disposed above the corresponding photosensitive drum 14, and is detachably supported by the process frame 15 at a position above the corresponding photosensitive drum 14. Each developing unit 13 includes a developing roller 18.

The developing roller 18 is disposed at a bottom section of the developing unit 13 and is rotatably supported. The rear side of the developing roller 18 is exposed so as to press the corresponding photosensitive drum 14 from the upper front side thereof.

Each developing unit 13 includes a supply roller 19 for supplying toner to the developing roller 18; and a layer thickness regulation blade 20 for regulating the thickness of toner supplied onto the developing roller 18. Each developing unit 13 accommodates toner of a corresponding color in an upper space above the supply roller 19 and layer thickness regulation blade 20.

(3-2-2) Developing Operation in Process Unit

Toner accommodated in the developing unit 13 is supplied to the supply roller 19, then supplied to the developing roller 18, and is positively triboelectrically charged between the supply roller 19 and developing roller 18.

As the developing roller 18 rotates, toner supplied on the developing roller 18 is regulated in its thickness by the layer thickness regulation blade 20, and is borne on the surface of the developing roller 18 as a thin layer of toner in a predetermined thickness.

A surface of each photosensitive drum 14 is uniformly charged by the corresponding Scorotron charger 16 as the photosensitive drum 14 rotates. Then, the surface of the photosensitive drum 14 is exposed by a high speed scanning of the scanner unit 8. Thus, an electrostatic latent image corresponding to an image to be formed on the paper P is formed on the surface of the photosensitive drum 14.

As the photosensitive drum 14 further rotates, the positively-charged tonner carried on the developing roller 18 is supplied onto the electrostatic latent image formed on the photosensitive drum 14. Thus, the electrostatic latent image formed on the surface of the photosensitive drum 14 is developed into a visible toner image through a reverse development. Thus, a toner image is formed and borne on the photosensitive drum 14.

(3-3) Transfer Unit

The transfer unit 10 extends in the front-to-rear direction and is disposed above the feeding unit 3 and below the process unit 9 in the main casing 2. The transfer unit 10 includes a drive roller 26, a follower roller 27, the conveying belt 25, and four transfer rollers 28.

The drive roller 26 and the follower roller 27 are in confrontation with each other in the front-to-rear direction and spaced at a predetermined interval.

The conveying belt 25 is stretched around the drive roller 26 and the follower roller 27 so that the conveying belt 25 is disposed below the photosensitive drums 14, and the upper portion of the conveying belt 25 contacts the photosensitive drums 14. The conveying belt 25 circulates in accordance with the rotation of the drive roller 26 so that the upper portion of the conveying belt 25 contacting the photosensitive drums 14 moves from front to rear.

The four transfer rollers 28 are disposed such that the upper section of the conveying belt 25 is nipped between each transfer roller 28 and the corresponding photosensitive drum 14.

The paper P supplied from the feeding unit 3 passes thorough transfer points formed between each photosensitive drum 14 and the corresponding transfer roller 28 from front to rear in accordance with the circularly movement of the conveying belt 25. Thus, the toner image formed on the surface of each photosensitive drum 14 is sequentially transferred and superimposed onto the paper P, thereby a color image being formed on the paper P.

Sometimes, toner remains on the surface of the photosensitive drum 14 after the toner image is transferred onto the paper P from the photosensitive drum 14. However, the residual toner is transferred and held on a peripheral surface of the drum cleaning roller 17 due to a cleaning bias applied to the drum cleaning roller 17, when the residual toner is opposed to the cleaning roller 17 in accordance with the rotation of the photosensitive drum 14.

(3-4) Fixing Unit

The fixing unit 11 is provided on an upper-rear side of the conveying belt 25. The fixing unit 11 is provided with a heat roller 29 and a pressure roller 30 that is pressed to contact the heat roller 29. The toner images transferred onto the paper P are fixed to the paper P by heat and pressure in the fixing unit 11 when the paper P passes through a position between the heat roller 29 and the pressure roller 30.

(4) Discharge Paper

The paper P fixed with toner images is conveyed by various discharge rollers 32 through a U-turn path 33, and discharged onto a discharge tray 34 formed above the scanner unit 8.

2. Details of Drum Unit (1) Process Frame

Figure 2:
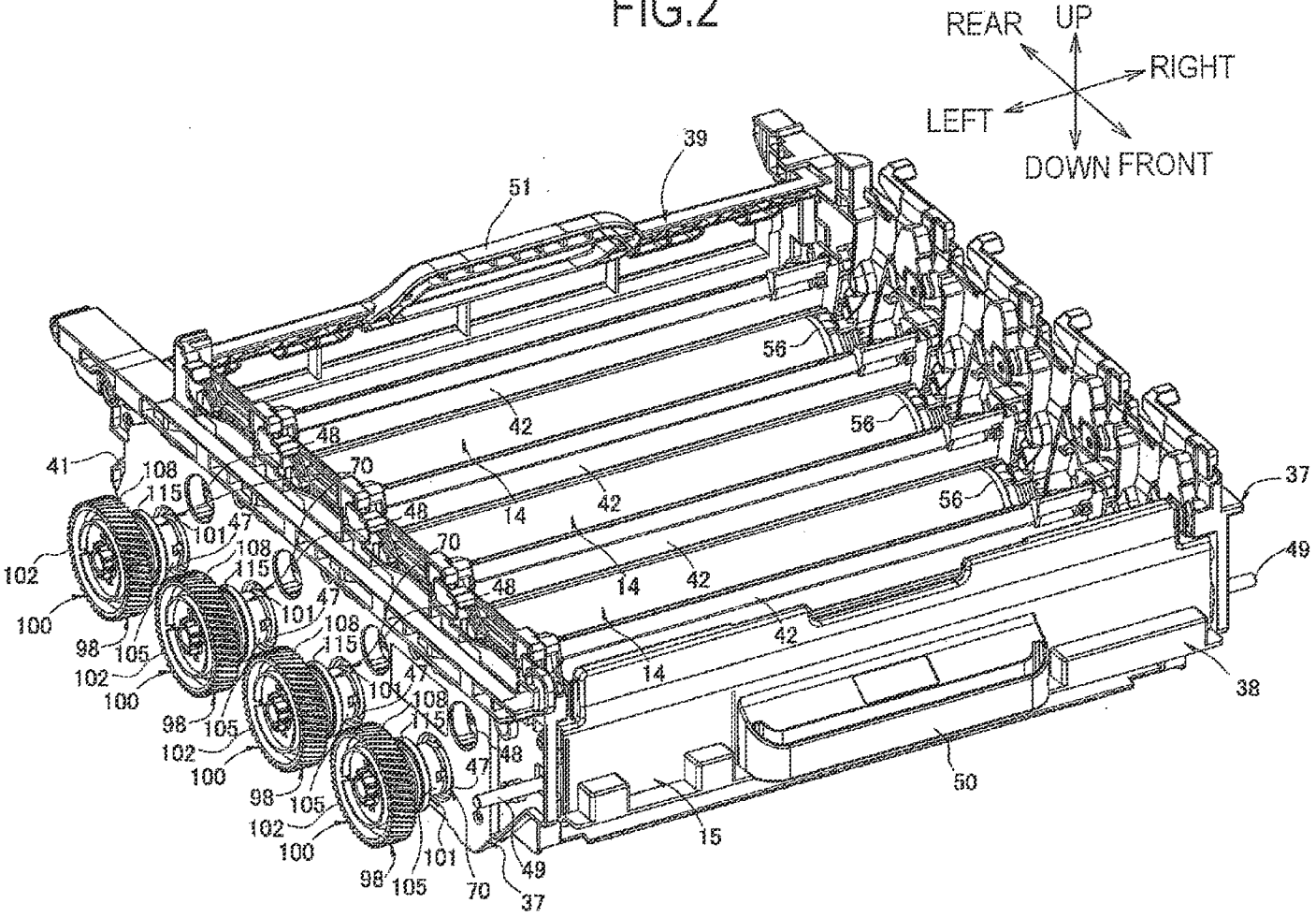
FIG. 2 is a perspective view of a drum unit seen from an upper left side.

As illustrated in FIG. 2, the process frame 15 includes a pair of side plates 37, a front beam 38, and a rear beam 39.

When seen in a side view, both the side plates 37 are formed in a generally rectangular shape extending in the front-to-rear direction. The side plates 37 each have a notch 41 in their rear edge. When seen in a side view, the notches 41 are formed in a general V shape toward the front.

The notches 41 are open to the rear. With the drum unit 24 (process unit 9) mounted in the main casing 2, the notches 41 receive a main body reference shaft 31 (to be described later) and make contact with the main body reference shaft 31 from above and from the lower front (see FIG. 1).

The side plates 37 each have drum support through-holes 47.

The drum support through-holes 47 have a generally circular shape when seen in a side view. Four drum support through-holes 47 are arranged at regular intervals in the front-to-rear direction.

The side plates 37 are laterally opposed to each other at a distance so that the centers of their respective drum support through-holes 47 coincide with each other when seen in a lateral projection.

Out of the pair of side plates 37, the left side plate 37 has formed with insertion through-holes 48.

The insertion through-holes 48 have a generally circular shape when seen in a side view. Four insertion through-holes 48 are arranged at regular intervals in the front-to-rear direction.

Specifically, the insertion through-holes 48 are arranged above and in front of the respective drum support through-holes 47 on a one-to-one basis at a distance in the vertical direction.

A drive source 200, such as a motor, is provided in the main casing 2 as shown in FIG. 1. Coupling members (not illustrated) for transmitting driving force from the drive source 200 are inserted through the insertion through-holes 48, and are connected to the developing units 13 so as to be capable of transmitting the driving force. The developing units 13 are driven in such a manner.

The front beam 38 spans between the front ends of the side plates 37. The front beam 38 is provided with a support shaft 49 and a front side grip part 50. The support shaft 49 runs laterally through the front beam 38. The support shaft 49 also runs through both the side plates 37 and protrudes laterally outward from the side plates 37. The front side grip part 50 is integrally formed on a lateral center part of the front surface of the front beam 38. The front side grip part 50 is formed in a generally rectangular shape when seen in a plan view. A front part of the front side grip part 50 is hollowed in a general U shape when seen in a plan view.

The rear beam 39 spans between the rear ends of the side plates 37. The rear beam 39 includes a rear side grip part 51. The rear side grip part 51 is integrally formed on a lateral center part of the top surface of the rear beam 39. The rear side grip part 51 is formed in a general U shape when seen in a rear view. Both free ends of the rear side grip part 51 are connected to the rear beam 39. The rear side grip part 51 is situated to protrude from the rear beam 39, obliquely upward and forward from below and behind.

The process frame 15 is provided with the four photosensitive drums 14 and four drum sub units 42 (see FIG. 1).

(2) Photosensitive Drums

Figure 3:
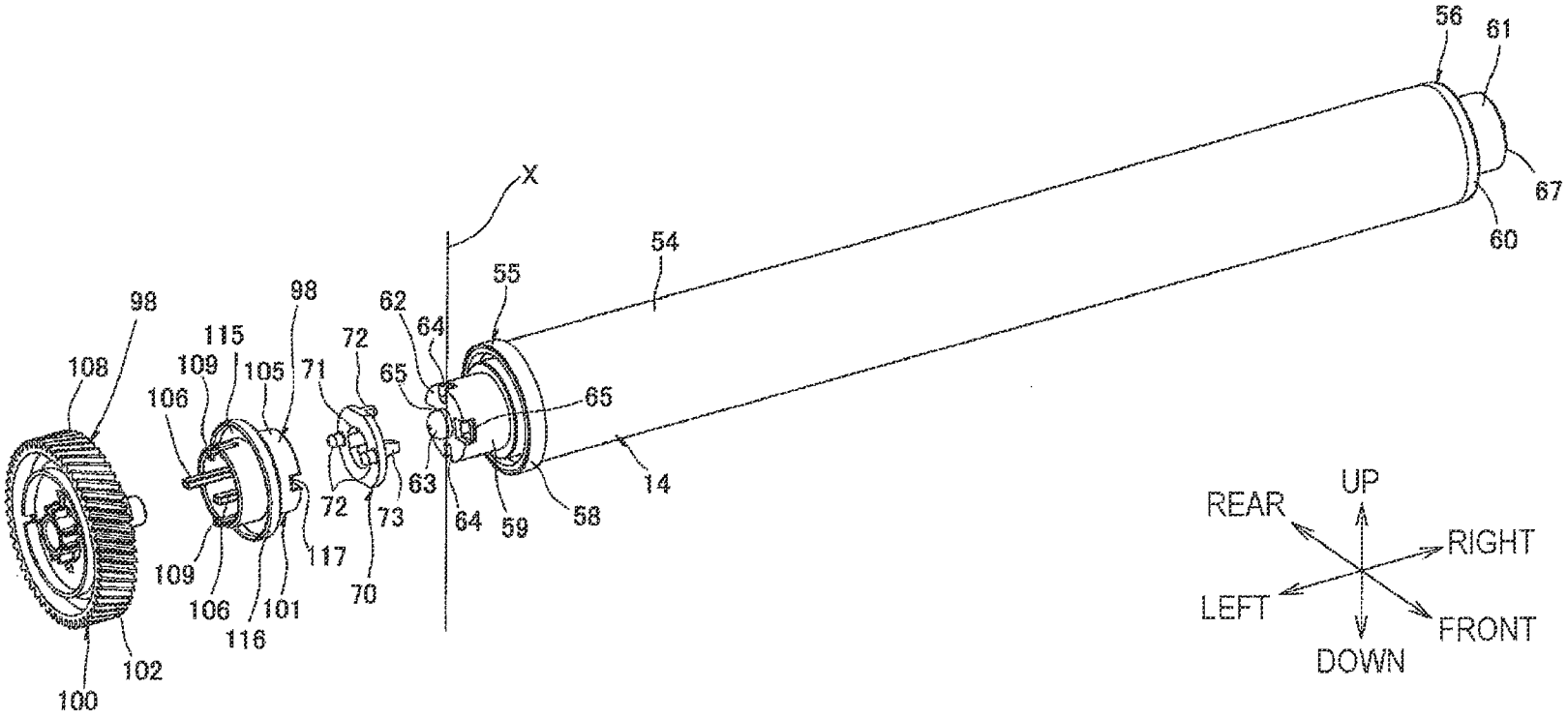
FIG. 3 is a perspective view of a disassembled state of a photosensitive drum and a drive member seen from an upper left side.

As illustrated in FIG. 3, each photosensitive drum 14 includes a tubular body 54, a left flange member 55, and a right flange member 56.

The tubular body 54 is made of metal. The tubular body 54 is formed in a generally circular cylindrical shape extending in the lateral direction. The outer periphery of the tubular body 54 is covered with a photosensitive layer.

(2-1) Left Flange Member

Figure 9:
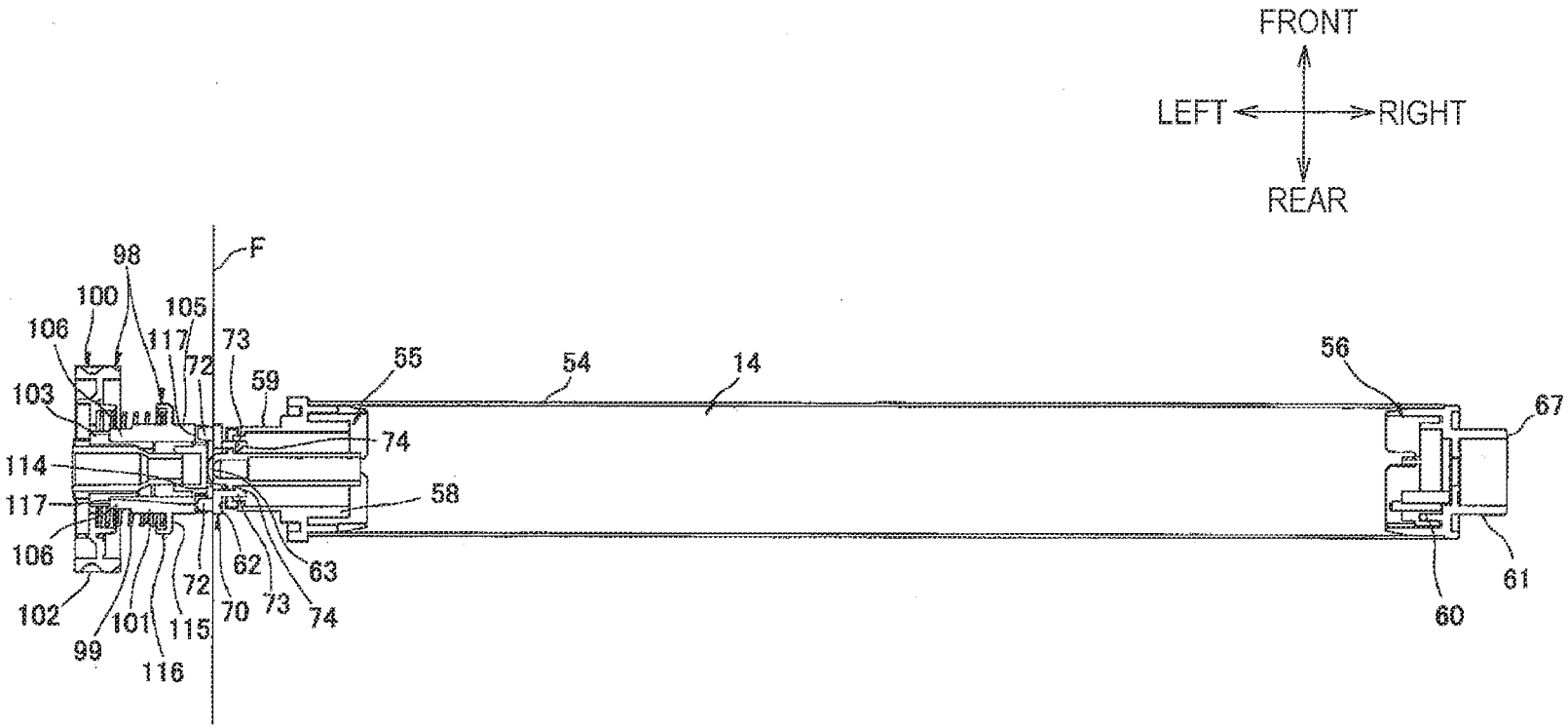
FIG. 9 is a cross-sectional view illustrating an Oldham coupling shown in FIG. 8.

The left flange member 55 is made of resin. As illustrated in FIGS. 3 and 9, the left flange member 55 integrally includes a left drum fitting part 58 and a left bearing fitting part 59.

The left drum fitting part 58 is formed in a generally circular columnar shape. The left drum fitting part 58 has an outer diameter generally the same as the inner diameter of the tubular body 54.

The left bearing fitting part 59 is formed in a generally circular columnar shape with a diameter smaller than the outer diameter of the left drum fitting part 58.

The left drum fitting part 58 and the left bearing fitting part 59 are arranged to have a common center axis. The left bearing fitting part 59 is formed to protrude outward (to the left) in the axial direction from the left drum fitting part 58 in a convex shape when seen in a cross section.

As illustrated in FIG. 3, the left end face of the left bearing fitting part 59 is sealed with a sealing wall 62.

The sealing wall 62 is formed in a generally circular disk-like shape. The sealing wall 62 includes a protrusion 63, drum coupling fitting through-holes 64, and engagement through-holes 65.

The protrusion 63 is formed in a general semi-arc shape when seen in a side view. The protrusion 63 is formed to protrude to the left from a center part of the sealing wall 62.

The lateral length of the protrusion 63 (the length from the sealing wall 62 to the extremity of the protrusion 63) is greater than the thickness of a slide member 70 (to be described later).

The drum coupling fitting through-holes 64 and the engagement through-holes 65 are formed in the circumferential edge of the sealing wall 62. When seen in a side view, the drum coupling fitting through-holes 64 and the engagement through-holes 65 each have a general U shape that is open radially outward.

There are two drum coupling fitting through-holes 64 which are formed so as to be opposed to each other in a radial direction of the left bearing fitting part 59. Similarly, there are two engagement through-holes 65 which are formed so as to be opposed to each other in a radial direction of the left bearing fitting part 59.

Specifically, the drum coupling fitting through-holes 64 and the engagement through-holes 65 are arranged at regular intervals in the circumferential direction, with a shift of approximately 90 degrees from each other.

When seen in a side view, the drum coupling fitting through-holes 64 and the engagement through-holes 65 are each formed in a generally rectangular shape that is long in the direction in which the drum coupling fitting through-holes 64 are opposed to each other (hereinafter, referred to as a first direction X).

A slide member 70 is supported on the sealing wall 62 of the left bearing fitting part 59.

Figure 4:
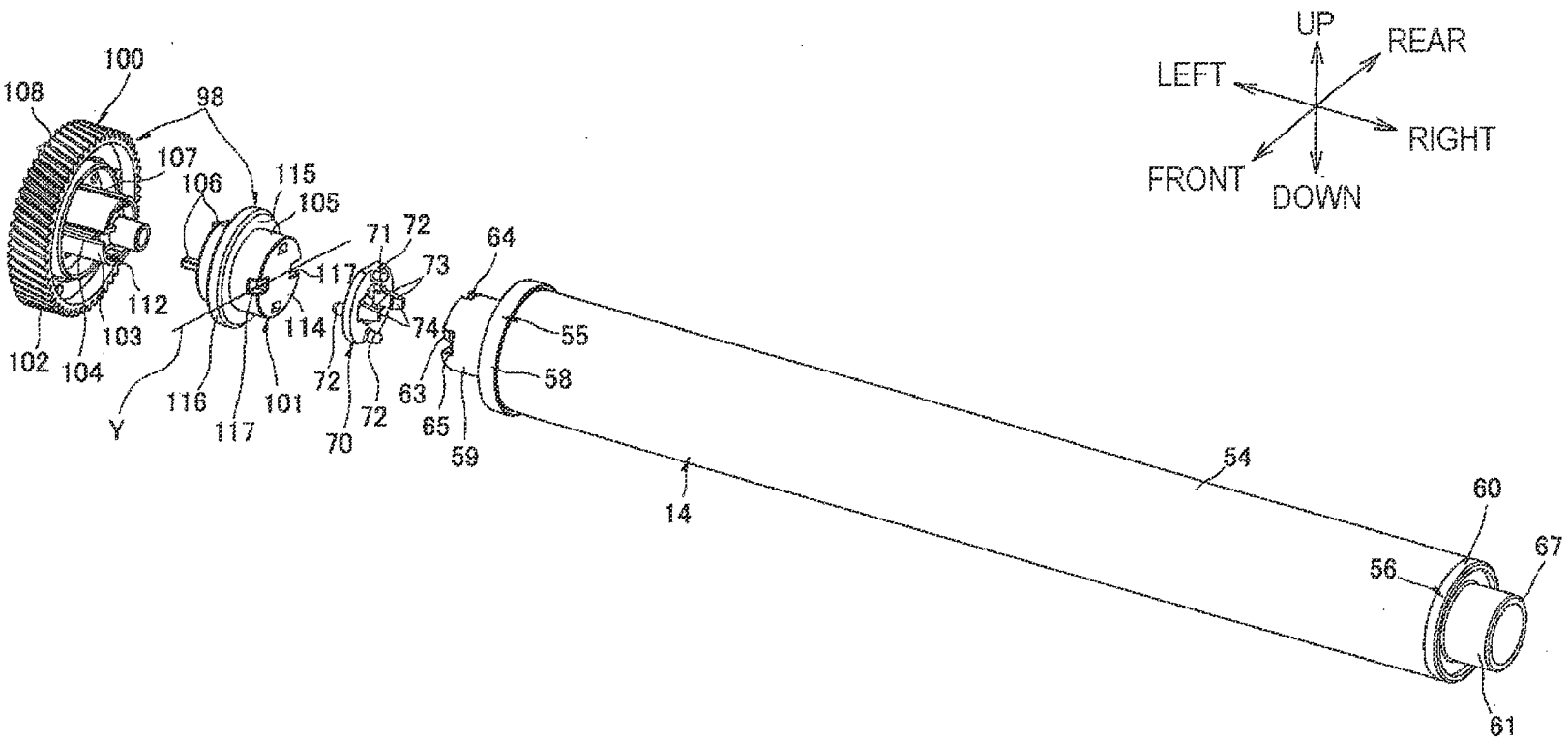
FIG. 4 is a perspective view of the disassembled state of the photosensitive drum and the drive member seen from an upper right side.

As illustrated in FIGS. 3 and 4, the slide member 70 is formed in a generally annular plate-like shape with an opening 71 in the center. The slide member 70 includes fitting protrusions 72 and latch protrusions 73.

The opening 71 is formed in a generally circular shape. The opening 71 has an inner diameter greater than the diameter of the circumferential outline of the protrusion 63 when seen in a lateral projection.

The fitting protrusions 72 are formed on both right and left side surfaces of the slide member 70. Two fitting protrusions 72 are formed on each surface, so as to protrude outward in a thickness direction.

Specifically, as illustrated in FIG. 3, two fitting protrusions 72 are formed on the left side surface of the slide member 70 so as to protrude to the left from the circumferential edge of the slide member 70. As illustrated in FIG. 4, two fitting protrusions 72 are formed on the right side surface of the slide member 70 so as to protrude to the right from the circumferential edge of the slide member 70.

On each of the right and left side surfaces of the slide member 70, the fitting protrusions 72 are radially opposed to each other. Each fitting protrusion 72 has a generally arc-shaped extremity.

The fitting protrusions 72 have an outer diameter smaller than the length of the drum coupling fitting through-holes 64 in the first direction X and the length of main casing side coupling fitting through-holes 117 (to be described later) in a second direction Y (to be described later).

As illustrated in FIGS. 3 and 4, the fitting protrusions 72 formed on the left side surface of the slide member 70 and the fitting protrusions 72 formed on the right side surface are arranged at regular intervals in the circumferential direction of the slide member 70 with a shift of approximately 90 degrees from each other when seen in a lateral projection.

As illustrated in FIG. 4, two latch protrusions 73 are formed on the right side surface of the slide member 70 so as to protrude to the right. The latch protrusions 73 are capable of elastic deformation, and are formed in a generally plate-like shape long in the lateral direction.

The length of the latch protrusions 73 in the first direction X (direction orthogonal to their longitudinal direction) is smaller than that of the engagement through-holes 65 in the first direction X.

The extremities of the latch protrusions 73 are formed as hook-like portions 74.

The hook-like portions 74 are formed with a cross section of hook-like shape, bending inward in the radial direction of the slide member 70.

The lateral length of the latch protrusions 73 is greater than the thickness of the sealing wall 62. Specifically, the lateral length from the bottoms of the latch protrusions 73 to the left end faces of the hook-like portions 74 is greater than the thickness of the sealing wall 62 (see FIG. 9).

The two latch protrusions 73 are opposed to each other in the radial direction of the slide member 70. Specifically, the latch protrusions 73 are arranged with a shift of approximately 90 degrees from the two fitting protrusions 72 formed on the right side surface. In other words, the two latch protrusions 73 are opposed to each other in a direction orthogonal to the first direction X (a second direction Y (to be described later)).

(2-2) Supporting Slide Member by Left Flange Member

As illustrated in FIG. 9, the latch protrusions 73 of the slide member 70 are inserted through the engagement through-holes 65 of the left flange member 55, and the hook-like portions 74 of the latch protrusions 73 are engaged with the inside surface (right side surface) of the sealing wall 62. In such a manner, the slide member 70 is supported by the left flange member 55.

The fitting protrusions 72 formed on the right side surface of the slide member 70 are inserted into the drum coupling fitting through-holes 64 (see FIG. 4).

Since the fitting protrusions 72 have an outer diameter smaller than the length of the drum coupling fitting through-holes 64 in the first direction X, the fitting protrusions 72 are fitted into the drum coupling fitting through-holes 64 with play in the first direction X.

The slide member 70 is thus fitted to the left flange member 55 so as to be capable of moving in the first direction X relative to the left flange member 55 and so as to be incapable of rotating relative to the left flange member 55.

The protrusion 63 of the left bearing fitting part 59 is inserted through the opening 71 of the slide member 70, and protrudes to the left from the slide member 70.

The slide member 70 can also make a lateral movement since the lateral length from the bottoms of the latch protrusions 73 to the left end faces of the hook-like portions 74 is greater than the thickness of the sealing wall 62.

(2-3) Right Flange Member

The right flange member 56 is made of resin. As illustrated in FIG. 9, the right flange member 56 integrally includes a right drum fitting part 60 and a right bearing fitting part 61.

The right drum fitting part 60 is formed in a generally circular columnar shape. The right drum fitting part 60 has an outer diameter generally the same as the inner diameter of the tubular body 54.

The right bearing fitting part 61 is formed in a generally cylindrical shape with a diameter smaller than the outer diameter of the right drum fitting part 60. The right end face of the right bearing fitting part 61 is open.

The right drum fitting part 60 and the right bearing fitting part 61 are arranged to have a common center axis. The right bearing fitting part 61 is formed to protrude outward (to the right) in the axial direction from the right drum fitting part 60 in a convex shape when seen in a cross section.

The right end of the right bearing fitting part 61 is formed as a sliding part 67.

The left drum fitting part 58 is pressed into the left end of the tubular body 54. The right drum fitting part 60 is pressed into the right end of the tubular body 54. The left flange member 55 and the right flange member 56 are thereby fitted to the tubular body 54 so as to be incapable of rotating relative to the tubular body 54.

(2-4) Bearing Members

As illustrated in FIG. 2, each photosensitive drum 14 is supported by both the side plates 37 of the process frame 15 so as to be capable of rotating relative to the side plates 37.

Figure 5:
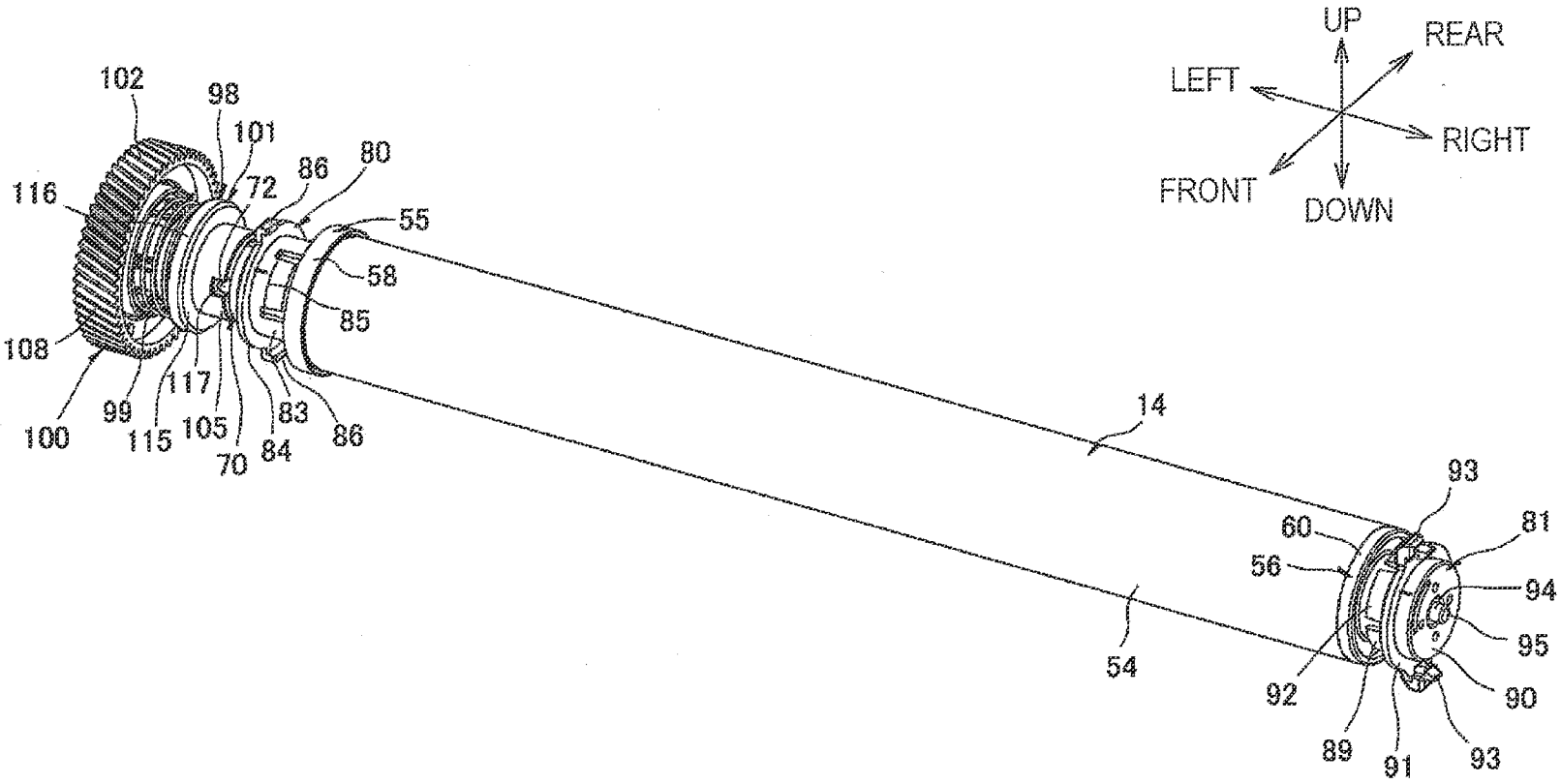
FIG. 5 schematically shows a state how the photosensitive drum is supported by a pair of side plates (bearing members), seen from a right side.
Figure 6:
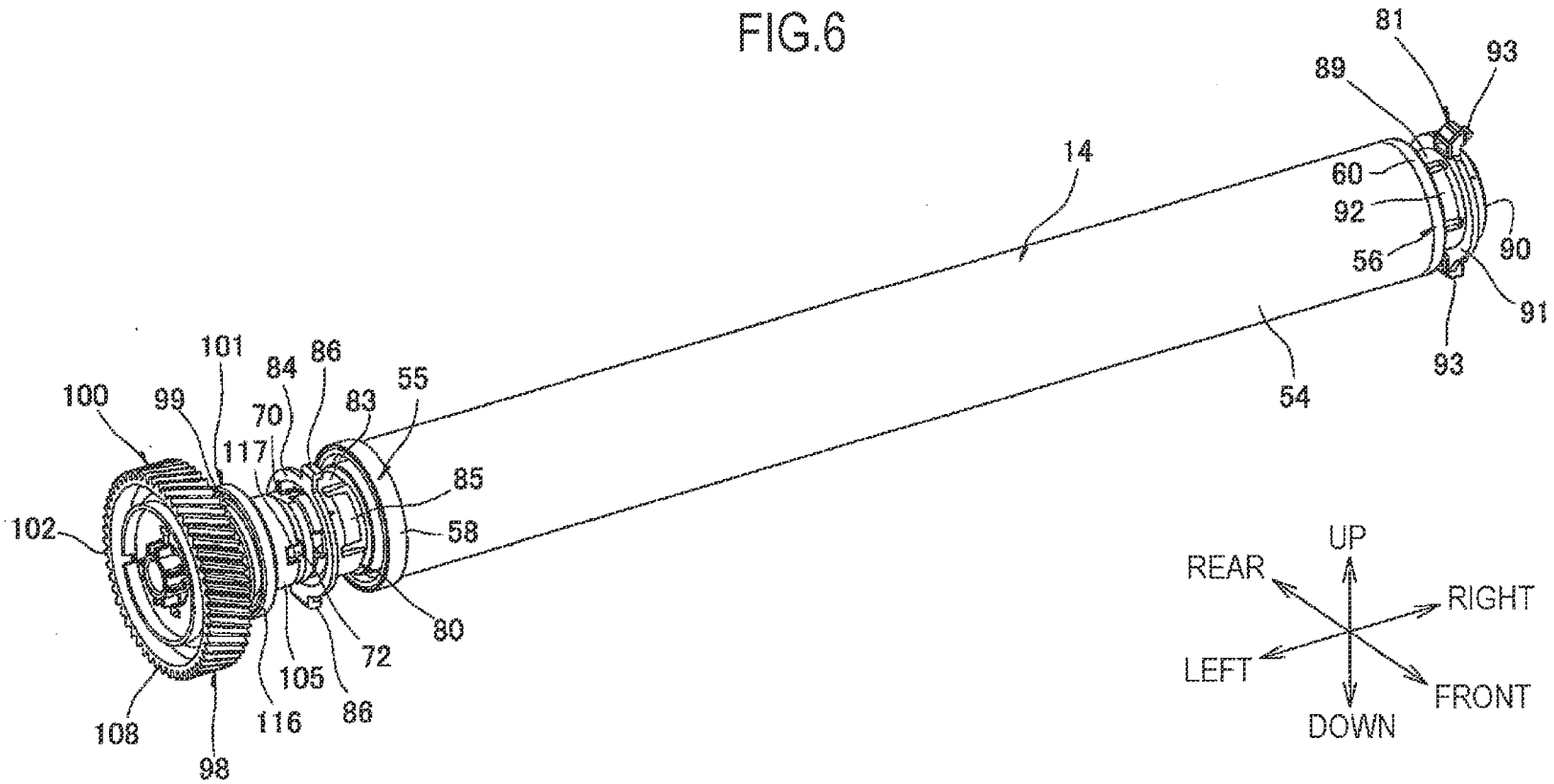
FIG. 6 schematically shows a state how the photosensitive drum is supported by the pair of side plates (bearing members), seen from a left side.

Specifically, as illustrated in FIGS. 5 and 6, the left flange member 55 is supported by the left side plate 37 through a left bearing member 80 so as to be capable of rotating relative to the left side plate 37. The right flange member 56 is supported by the right side plate 37 through a right bearing member 81 so as to be capable of rotating relative to the right side plate 37.

(2-4-1) Left Bearing Member

The left bearing member 80 is made of resin, and integrally includes a cylindrical part 83 and a collar part 84.

The cylindrical part 83 is formed in a generally circular cylindrical shape. The cylindrical part 83 has an outer diameter generally the same as the inner diameter of the drum support through-holes 47 formed in the left side plate 37 (see FIG. 2). The cylindrical part 83 has an inner diameter slightly greater than the outer diameter of the left bearing fitting part 59.

The cylindrical part 83 includes a pressing part 85.

A pair of slits is formed leftward in the right edge of the cylindrical part 83 so as to be separated from each other in the circumferential direction of the cylindrical part 83. The pressing part 85 is formed as a portion lying between the pair of slits.

The pressing part 85 has a curved shape long in the circumferential direction. The pressing part 85 is formed to extend to the right from an axial midsection of the cylindrical part 83.

The collar part 84 is formed in a generally annular plate-like shape that spreads radially outward from the circumferential edge of the left end of the cylindrical part 83.

Latch parts 86 are formed on the outer rim of the collar part 84. The latch parts 86 are formed in a general L shape when seen in a side view. There are formed two latch parts 86 which are radially opposed in the radial direction of the collar part 84.

(2-4-2) Right Bearing Member

The right bearing member 81 is made of resin. As illustrated in FIGS. 5 and 6, the right bearing member 81 integrally includes a cylindrical part 89, a sealing part 90, and a collar part 91.

The cylindrical part 89 is formed in a generally circular cylindrical shape. The cylindrical part 89 has an outer diameter generally the same as the inner diameter of the drum support through-holes 47 formed in the right side plate 37 (see FIG. 2). The cylindrical part 89 has an inner diameter slightly greater than the outer diameter of the right bearing fitting part 61.

The cylindrical part 89 includes a pressing part 92. A pair of slits is formed rightward in the left edge of the cylindrical part 89 so as to be separated from each other in the circumferential direction of the cylindrical part 89. The pressing part 92 is formed as a portion lying between the pair of slits. The pressing part 92 has a curved shape long in the circumferential direction. The pressing part 92 is formed to extend to the left from an axial midsection of the cylindrical part 89.

As illustrated in FIG. 5, the sealing part 90 has a generally circular disk-like shape. The sealing part 90 is formed to seal the right end face of the cylindrical part 89. When the right bearing fitting part 61 is inserted into the right bearing member 81, the inside surface of the sealing part 90 is opposed to and slides over the sliding part 67 so that the right flange member 56 is capable of rotating relative to the right bearing member 81.

A shaft 94 is integrally held on the center area of the sealing part 90. The shaft 94 protrudes to the right from the sealing part 90, and is arranged to coincide with the central axis of the cylindrical part 89. The extremity of the shaft 94 is formed as a part to be positioned 95.

The collar part 91 is formed on the outer periphery of the cylindrical part 89. The collar part 91 is formed in a generally annular plate-like shape that spreads radially outward from an axial midsection of the cylindrical part 89.

Latch parts 93 are formed on the outer rim of the collar part 84. Each latch part 93 has a general L shape when seen in a side view and has a generally hook-like free end. There are formed two latch parts 93 which are radially opposed in the radial direction of the collar part 84.

(2-5) Attaching Photosensitive Drum to Process Frame

As illustrated in FIG. 2, to attach a photosensitive drum 14 to the process frame 15, the right bearing fitting part 61 of the right flange member 56 is initially inserted into the cylindrical part 89 of the right bearing member 81. The pressing part 92 formed on the cylindrical part 89 elastically contacts the outer periphery of the right baring fitting part 61.

Next, the cylindrical part 89 of the right bearing member 81 is inserted into a drum support through-hole 47 in the right side plate 37 from the inner side (left side) of the right side plate 37 in the lateral direction. The collar part 91 comes into contact with the left side surface of the right side plate 37, whereby a further movement of the right bearing member 81 to the right is restricted. The two latch parts 93 are engaged with the right side plate 37, whereby the right bearing member 81 is supported on the side plate 37. The pressing part 92 presses the right bearing fitting part 61 toward the inner periphery of the drum support through-hole 47. The right end of the photosensitive drum 14 is thereby positioned.

At this stage, the left flange member 55 is located in a drum support through-hole 47 of the left side plate 37. The cylindrical part 83 of the left bearing member 80 is inserted into the drum support through-hole 47 from the outer side (left side) of the left side plate 37 in the lateral direction so that the cylindrical part 83 is disposed between the outer periphery of the left bearing fitting part 59 of the left flange member 55 and the drum support through-hole 47.

The pressing part 85 formed on the cylindrical part 83 elastically contacts the outer periphery of the left flange member 55, whereby the left bearing fitting part 59 is pressed toward the inner periphery of the drum support through-hole 47. The left end of the photosensitive drum 14 is thereby positioned.

As illustrated in FIG. 6, the slide member 70 supported by the sealing wall 62 is exposed from the left end face of the left bearing member 80.

When the mounting of the left bearing member 80 on the drum support through-hole 47 is completed, the collar part 84 is in contact with the outside surface (left side surface) of the left side plate 37. A further movement of the left bearing member 80 to the right is thereby restricted, and the left bearing member 80 is positioned in the lateral direction (the axial direction of the photosensitive drum 14). The two latch parts 86 are engaged with the left side plate 37 to retain the lateral positioning of the left bearing member 80. This completes the attachment of the photosensitive drum 14 to the process frame 15.

(3) Drum Sub Units

As illustrated in FIG. 2, four drum sub units 42 are arranged between the two side plates 37 and between the front beam 38 and the rear beam 39. The drum sub units 42 are juxtaposed with one another and are arranged at regular intervals in the front-to-rear direction so as to come behind and above the respective photosensitive drums 14.

Each drum sub unit 42 is formed in a generally triangular prismatic shape extending in the lateral direction when seen in a side view (see FIG. 1). Each drum sub unit 42 includes the Scorotron charger 16 and the drum cleaning roller 17 which are held along the lateral direction.

3. Details of Main Casing (1) Main Body Reference Shaft and Positioning Parts

Figure 7:
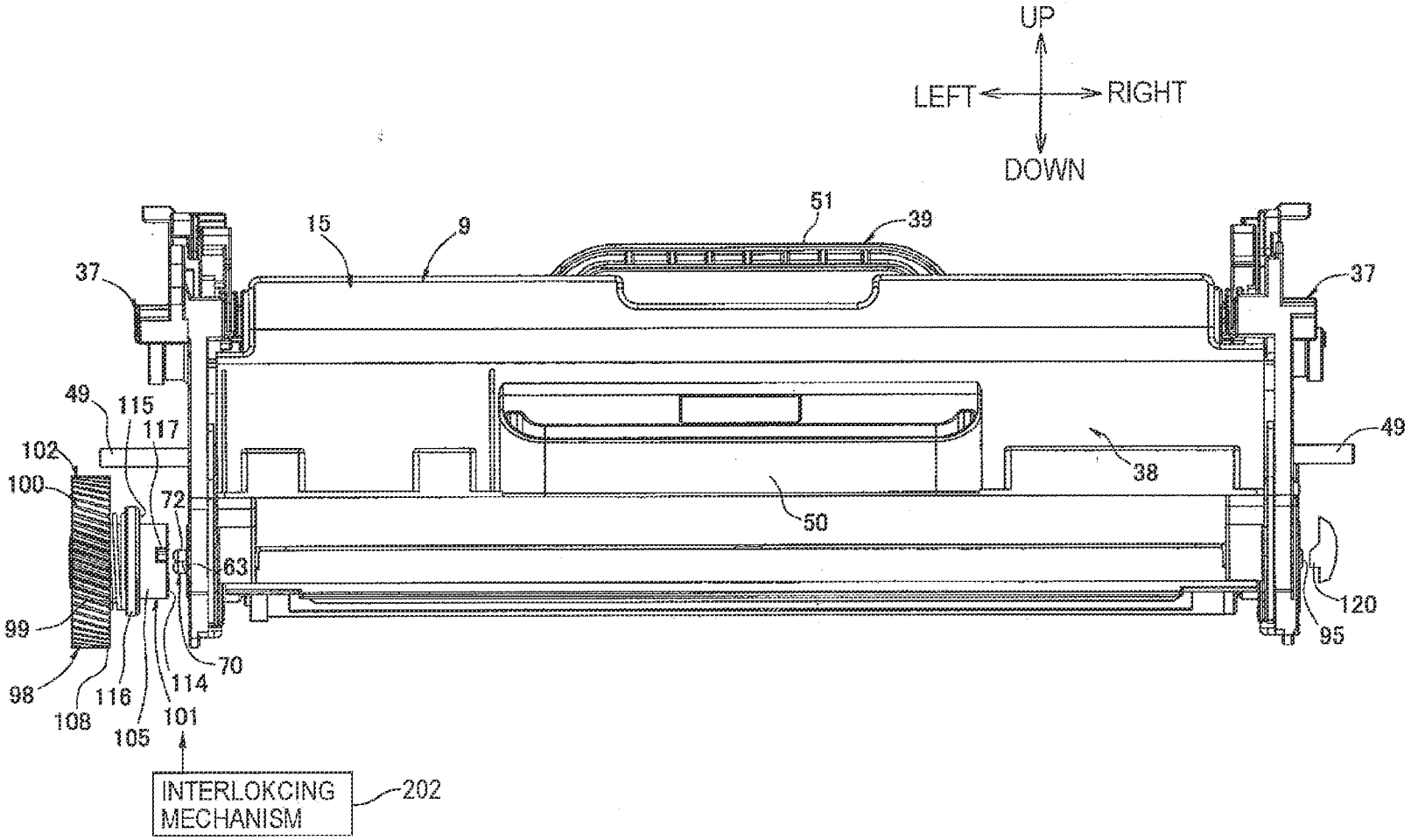
Figure 8:
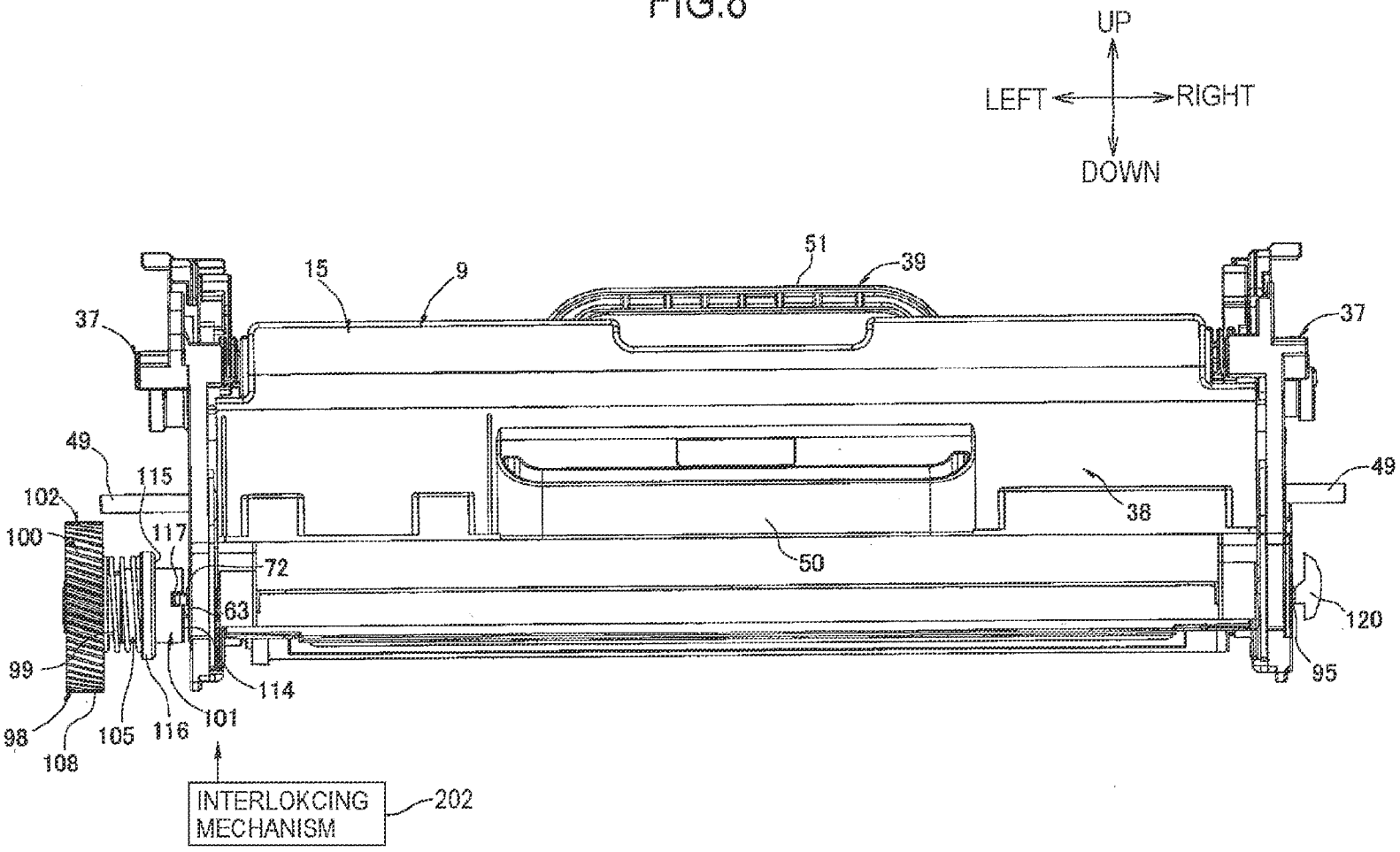

As illustrated in FIGS. 1, 7, and 8, the main casing 2 includes the main body reference shaft 31 and positioning parts 120.

As illustrated in FIG. 1, the main body reference shaft 31 is a generally rod-shaped member. The main body reference shaft 31 is arranged across the entire lateral length in a rear side portion of the main casing 2.

As illustrated in FIGS. 7 and 8, the positioning parts 120 protrude from an inner surface of the main casing 2. FIGS. 7 and 8 show how one positioning part 120 protrudes from the inner surface of the main casing 2, wherein only a part of the main casing 2 is shown in the drawings. The positioning parts 120 are arranged in positions opposed to the parts to be positioned 95 of the respective photosensitive drums 14 in the lateral direction when the process unit 9 is mounted on the main casing 2.

(2) Drive Members

As illustrated in FIGS. 2 and 5, the main casing 2 also includes drive members 98 and spring members 99. As illustrated in FIGS. 5 and 9, the spring members 99 are formed in an air-core coil shape.

As illustrated in FIG. 2, four drive members 98 are arranged so as to correspond to the respective photosensitive drums 14 when the process unit 9 is mounted in the main casing 2.

As illustrated in FIGS. 3 and 4, each drive member 98 includes a rotation drive member 100 and a reciprocation member 101.

As illustrated in FIG. 4, the rotation drive member 100 includes an inner cylinder part 103 and a gear part 102.

The inner cylinder part 103 is formed in a generally circular cylindrical shape. Slits 104 and grooves 107 are formed in the inner cylinder part 103.

Two slits 104 are formed over the entire axial length of the inner cylinder part 103. The slits 104 are formed to engage with two bars 106 (to be described later) formed on an outer cylinder part 105 (to be described later). The two slits 104 are opposed to each other in the radial direction of the inner cylinder part 103.

Figure 10:
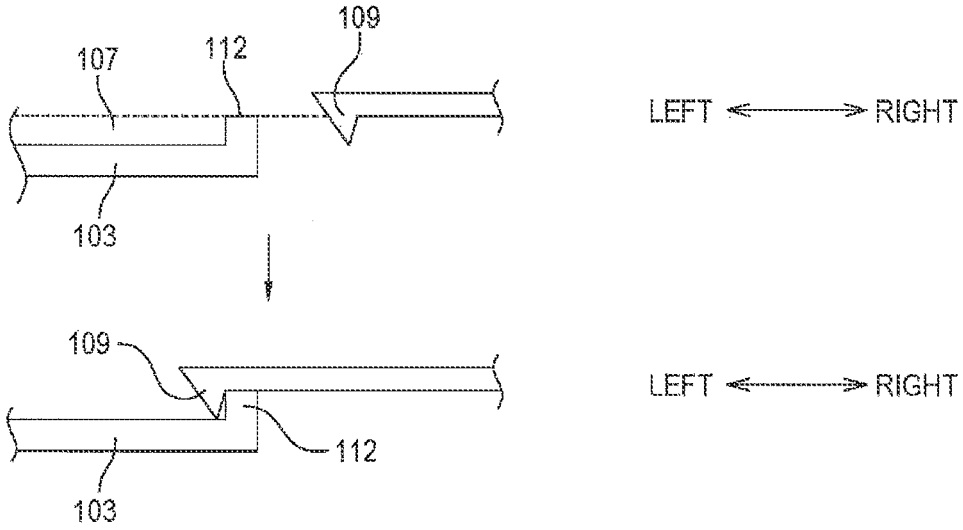
FIG. 10 shows how to engage a latch tab in a reciprocation member with a bend part in a rotation drive member, wherein an upper side in FIG. 10 shows a state that the latch tab is arranged so as to be opposed to the bend part, and the lower side in FIG. 10 shows a state that the latch tab is engaged with the bend part.

Two grooves 107 are formed on the outer periphery of the inner cylindrical part 103. The grooves 107 are formed to extend in the axial direction of the inner cylindrical part 103. The grooves 107 are in a concave shape and are formed radially inward in the outer periphery of the inner cylinder part 103. When seen in a side view, the grooves 107 are generally U-shaped recesses. The grooves 107 are not opened on the right side edge of the inner cylinder part 103. Instead, bend parts 112 are formed on the right side ends of the grooves 107 as shown in FIG. 10. The bend parts 112 are located on the right side edge of the inner cylinder part 103. The bend parts 112 are bent outward in the radial direction of the inner cylinder part 103. The bend parts 112 are formed to engage with two latch tabs 109 (to be described later) formed on the outer cylinder part 105 (to be described later).

The gear part 102 is formed in a generally annular plate-like shape that spreads radially outward from the outer periphery of the axial outer end of the inner cylinder part 103. Engagement teeth 108 are formed on the peripheral surface of the gear part 102. The engagement teeth 108 are for receiving driving force that is transmitted from the drive source 200 provided in the main casing 2.

The inner cylinder part 103 and the gear part 102 are integrally formed so that the axis of rotation of the gear part 102 coincides with the axis of the inner cylinder part 103.

As illustrated in FIGS. 3 and 4, the reciprocation member 101 integrally includes the outer cylinder part 105, a contact wall 114, and a collar part 115.

The outer cylinder part 105 is formed in a generally circular cylindrical shape. The outer cylinder part 105 has an inner diameter slightly greater than the outer diameter of the inner cylinder part 103.

As illustrated in FIG. 3, the outer cylinder part 105 includes two bars 106 and two latch tabs 109.

The two bars 106 are formed with a generally rectangular cross section, and fixed to the inner periphery of the outer cylinder part 105. The bars 106 are formed to extend over the entire axial length of the outer cylinder part 105 and protrude to the left from the left end of the outer cylinder part 105. The two bars 106 are opposed to each other in the radial direction of the outer cylinder part 105.

The two latch tabs 109 are each formed as a portion lying between a pair of slits. The slits are formed rightward in the left edge of the outer cylinder part 105 so as to be separated from each other in the circumferential direction of the outer cylinder part 105.

The latch tabs 109 are formed in a general L shape when seen in a side view. The latch tabs 109 are formed to extend to the left from an axial midsection of the outer cylinder part 105.

The extremities of the latch tabs 109 are formed to protrude to the left from the left end of the outer cylinder part 105 and to bend inward in the radial direction of the outer cylinder part 105 as shown in FIG. 10, wherein FIG. 10 shows the part of one latch tab 109 that protrudes from the outer cylinder part 105. The two latch tabs 109 are opposed to each other in the radial direction of the outer cylinder part 105. The bars 106 and the latch tabs 109 are arranged at regular intervals in the circumferential direction, with a shift of approximately 90 degrees from each other.

As illustrated in FIG. 4, the contact wall 114 is formed in a generally circular disk-like shape. The contact wall 114 is formed to seal the right end face of the outer cylinder part 105.

The contact wall 114 has the main casing side coupling fitting through-holes 117.

The main casing side coupling fitting through-holes 117 are formed in the circumferential edge of the contact wall 114. When seen in a side view, the main casing side coupling fitting through-holes 117 have a general U shape that is open radially outward.

There are formed two main casing side coupling fitting through-holes 117 which are opposed to each other in the radial direction of the outer cylinder part 105.

The direction in which the two main casing side coupling fitting through-holes 117 are opposed will be referred to as a second direction Y.

The collar part 115 is formed on the outer periphery of the outer cylinder part 105. The collar part 115 is formed in a generally annular plate-like shape that spreads radially outward from an axial midsection of the outer cylinder part 105.

The collar part 115 has an outer diameter greater than the outer diameter of the spring member 99. The collar part 115 includes an extended part 116 which extends to the left from the circumferential edge of the collar part 115.

(3) Assembling Drive Member

Next, description will be given of assembly of a drive member 98.

To assemble a drive member 98, as illustrated in FIGS. 5 and 9, the inner cylinder part 103 of a rotation drive member 100 is initially passed through a spring member 99.

Next, a reciprocation member 101 is attached to the rotation drive member 100.

The reciprocation member 101 is attached to the rotation drive member 100 in the following manner. The reciprocation member 101 is initially positioned so that the two slits 104 of the inner cylinder part 103 are opposed to the two respective bars 106 of the outer cylinder part 105 in the axial direction of the inner cylinder part 103. The bend parts 112 of the inner cylinder part 103 are also opposed to the respective latch tabs 109 of the outer cylinder part 105 in the axial direction of the inner cylinder part 103 as shown in the upper side in FIG. 10.

The outer cylinder part 105 of the reciprocation member 101 is then fitted onto the inner cylinder part 103 of the rotation drive member 100 so that the slits 104 and the bars 106 are slidably engaged with each other. As a result, the extremities of the latch tabs 109 and the bend parts 112 are elastically engaged with each other as shown in the lower side in FIG. 10.

The reciprocation member 101 is thereby attached to the rotation drive member 100.

The engagement of the slits 104 with the bars 106 engages the rotation drive member 100 and the reciprocation member 101 in a manner that the rotation drive member 100 and the reciprocation member 101 are capable of sliding along the axial direction relative to each other and are incapable of rotating relative to each other.

The spring member 99 is sandwiched between the right surface of the gear part 102 and the left surface of the collar part 115. The extended part 116 formed on the collar part 115 covers and fixes the spring member 99.

Consequently, the reciprocation member 101 is urged to the right by an urging force from the spring member 99. In the meantime, the engagement of the bend parts 112 and the latch tabs 109 restricts a further advancement of the reciprocation member 101.

The drive member 98 is assembled in the foregoing manner.

4. Positioning Process Unit to Main Casing

Next, the positioning of the process unit 9 with respect to the main casing 2 will be described.

As illustrated in FIG. 1, when the process unit 9 is mounted in the main casing 2, the notches 41 in both the side plates 37 make contact with the upper side and the front lower side of the main body reference shaft 31.

This restricts the movement of the process unit 9 in the front-to-rear direction, whereby the process unit 9 is positioned with respect to the main casing 2 in the front-to-rear direction.

As illustrated in FIGS. 7 and 8, the reciprocation member 101 in each drive member 98 is moved between a retracted position (FIG. 7) and an advanced position (FIG. 8) according to the opening/closing of the front cover 5 by a well-known interlocking mechanism 202 (FIGS. 1, 7, and 8) that operatively interlocks the front cover 5 to the reciprocation member 101.

Specifically, when the front cover 5 is opened, the reciprocation member 101 of each drive member 98 moves from the advanced position to the retracted position. That is, the interlocking mechanism 202 moves the reciprocation member 101 from the advanced position to the retracted position against the urging force by the spring member 99. When the front cover 5 is closed, the reciprocation member 101 moves from the retracted position to the advanced position. That is, the interlocking mechanism 202 allows the reciprocation member 101 to move from the retracted position to the advanced position by the urging force by the spring member 99.

Suppose that the process unit 9 is mounted in the main casing 2. In the retracted position, as illustrated in FIG. 7, the slide member 70 supported by the left flange member 55 is laterally separated from the reciprocation member 101.

Specifically, in the left area of the main casing 2, the left side surface of the slide member 70 exposed from the drum support through-hole 47 and the contact wall 114 of the reciprocation member 101 are opposed to each other at a distance in the lateral direction.

In the right area of the main casing 2, the part to be positioned 95 of the right bearing fitting part 61 exposed from the drum support through-hole 47 and the corresponding positioning part 120 are opposed to each other at a distance in the lateral direction.

In the state where the process unit 9 is mounted in the main casing 2, when the front cover 5 is closed, the reciprocation member 101 in each drive member 98 is brought into the advanced position. That is, as illustrated in FIG. 8, the reciprocation member 101 advances from the retracted position in a direction toward the left flange member 55 of the photosensitive drum 14.

Specifically, the reciprocation member 101 is urged by the urging force of the spring member 99 in a direction toward the left flange member 55 and advances to the right.

The two fitting protrusions 72 of the slide member 70 supported by the left flange member 55 come into the two main casing side coupling fitting through-holes 117 formed in the contact wall 114 of the reciprocation member 101.

Since the fitting protrusions 72 have an outer diameter smaller than the length of the main casing side coupling fitting through-holes 117 in the second direction Y, the fitting protrusions 72 are fitted into the main casing side coupling fitting through-holes 117 with play in the second direction Y.

The slide member 70 is thereby fitted to the reciprocation member 101 so as to be capable of moving in the second direction Y relative to the reciprocation member 101 and so as to be incapable of rotating relative to the reciprocation member 101.

As a result, the reciprocation member 101, the slide member 70, and the left bearing fitting part 59 constitute an Oldham coupling. In other words, the slide member 70 couples the reciprocation member 101 and the left bearing fitting part 59 in the axial direction of the drive member 98.

As illustrated in FIG. 9, the protrusion 63 of the left bearing fitting part 59 and the contact wall 114 of the reciprocation member 101 contact with each other due to the urging force of the spring member 99.

This prevents the urging force of the spring member 99 from acting on the slide member 70. Instead, the urging force acts on the left flange member 55 of the photosensitive drum 14 directly from the reciprocation member 101 through the protrusion 63 and the contact wall 114. The urging force then acts on the process frame 15, i.e., the process unit 9 through the left flange member 55.

As illustrated in FIG. 8, the entire process frame 15 (process unit 9) is thereby moved to the right, and the parts to be positioned 95 come into contact with the respective positioning parts 120.

Consequently, the process unit 9 is positioned in the lateral direction. In other words, the photosensitive drums 14 are laterally positioned with respect to the main casing 2.

5. Inputting Driving Force to Photosensitive Drums

After completing the positioning of the photosensitive drums 14 with respect to the main casing 2, driving force transmitted from the drive source 200 is transmitted to each rotation drive member 100 through the engagement teeth 108 of the gear part 102.

The rotation drive member 100 is engaged with the reciprocation member 101 so as to be incapable of rotating relative to the reciprocation member 101. The rotation drive member 100 and the reciprocation member 101 are therefore integrally driven to rotate by the driving force transmitted to the rotation drive member 100.

Since the reciprocation member 101, the slide member 70, and the left bearing fitting part 59 form an Oldham coupling, the driving force can be transmitted from the drive member 98 to the left flange member 55 through the slide member 70.

As illustrated in FIG. 9, the urging force of the spring member 99 does not act on the slide member 70. Instead, the urging force acts on the left flange member 55 of the photosensitive drum 14 directly from the reciprocation member 101 through the protrusion 63 and the contact wall 114.

As described above, the slide member 70 is movable in the first direction X within the range of play in the first direction X between the fitting protrusions 72 and the drum coupling fitting through-holes 64. The slide member 70 is also movable in the second direction Y within the range of play in the second direction Y between the fitting protrusions 72 and the main casing side coupling fitting through-holes 117.

The slide member 70 has a thickness smaller than the lateral length of the protrusions 63. The latch protrusions 73 are formed so that the lateral length from the bottoms to the left end faces of the hook-like portions 74 is greater than the thickness of the sealing wall 62. The opening 71 has a diameter greater than that of the circumferential outline of the protrusion 63 when seen in a lateral projection.

The slide member 70 can thus move between the contact wall 114 of the reciprocation member 101 and the sealing wall 62 of the left bearing fitting part 59.

This allows a favorable movement of the slide member 70 in directions orthogonal to the axial direction of the drive member 98. That is, a predetermined range of positional deviations between the centers of rotation of the reciprocation member 101 and the left bearing fitting part 59 on a plane F orthogonal to the axial direction (lateral direction) of the drive member 98 can be favorably allowed.

More specifically, the slide member 70 can favorably allow a positional deviation between the centers of rotation of the reciprocation member 101 and the left bearing fitting part 59 within the following two ranges of play: the range of play in the first direction X between the fitting protrusions 72 and the drum coupling fitting through-holes 64, and the range of play in the second direction Y between the fitting protrusions 72 and the main casing side coupling fitting through-holes 117.

The left drum fitting part 58 of the left flange member 55 is fitted to the tubular body 54 so as to be incapable of rotating relative to the tubular body 54 and so as to be incapable of moving relative to the tubular body 54 in the axial direction of the tubular body 54. The left bearing fitting part 59 is supported by the left bearing member 80 so as to be capable of rotating relative to the left bearing member 80 and so as to be incapable of moving relative to the left bearing member 80 in the axial direction of the tubular body 54. The left bearing member 80 is supported by the left-side side plate 37 so as to be incapable of rotating relative to the side plate 37 and so as to be incapable of moving relative to the side plate 37 in the axial direction of the tubular body 54.

The right drum fitting part 60 of the right flange member 56 is fitted to the tubular body 54 so as to be incapable of rotating relative to the tubular body 54 and so as to be incapable of moving relative to the tubular body 54 in the axial direction of the tubular body 54. The right bearing fitting part 61 is supported by the right bearing member 81 so as to be capable of rotating relative to the right bearing member 81 and so as to be incapable of moving relative to the right bearing member 81 in the axial direction of the tubular body 54. The right bearing member 81 is supported by the right-side side plate 37 so as to be incapable of rotating relative to the side plate 37 and so as to be incapable of moving relative to the side plate 37 in the axial direction of the tubular body 54.

Specifically, the sliding part 67 of the right bearing member 81 rotatably slides over the inside surface of the sealing part 90 of the right bearing member 81.

Consequently, if driving force is transmitted to the left flange members 55, the respective photosensitive drums 14 are driven to rotate as supported by the side plates 33.

In such a manner, driving force transmitted from the drive source 200 is transmitted to the left flange members 55 through the respective drive members 98 and slide members 70, whereby the respective photosensitive drums 14 are driven to rotate.

6. Operations (1) The color laser printer 1 includes the main casing 2 and the drum unit 24. The drum unit 24 can be pulled out of the main casing 2 in the front-to-rear direction. The main casing 2 includes the drive members 98. The drum unit 24 includes the plurality of photosensitive drums 14 each including the left flange member 55. The right end faces of the reciprocation members 101 in the drive members 98 are sealed by the contact walls 114. The protrusions 63 are formed on the left bearing fitting parts 59 of the left flange members 55.

When the drive members 98 and the left flange members 55 are connected through the slide members 70, the contact walls 114 come into contact with the protrusions 63. The slide members 70 are thereby prevented from being sandwiched between the reciprocation members 101 and the left bearing fitting parts 59. Urging force from the spring members 99 do not act on the slide members 70, but on the left bearing fitting parts 59 directly from the reciprocation members 101.

As a result, the slide members 70 are not pressed against the reciprocation members 101 or the left bearing fitting parts 59. This allows a favorable relative movement between the reciprocation members 101 and the left bearing fitting parts 59 in the directions orthogonal to the axial direction of the drive members 98.

That is, the slide members 70 can favorably allow a predetermined range of positional deviations between the centers of rotation of the reciprocation members 101 and the left bearing fitting parts 59 on the plane F orthogonal to the axial direction of the drive members 98. Specifically, each slide member 70 can favorably allow a positional deviation between the centers of rotation of the reciprocation member 101 and the left bearing fitting part 59 within the following two ranges of play: the range of play in the first direction X between the fitting protrusions 72 and the drum coupling fitting through-holes 64, and the range of play in the second direction Y between the fitting protrusions 72 and the main casing side coupling fitting through-holes 117. Consequently, even if the centers of rotation of the reciprocation members 101 and the left bearing fitting parts 59 have some deviations therebetween, the displacements are allowed so that the rotation drive of the drive members 98 can be favorably transmitted to the left flange members 55.

(2) Each slide member 70 can move in the lateral direction (the axial direction of the reciprocation member 101) between the contact wall 114 and the sealing wall 62 of the left bearing fitting part 59. This prevents the urging force of the spring member 99 from acting on the slide member 70. The slide member 70 can make a favorable movement in the directions orthogonal to the axial direction of the drive member 98 with high accuracy. The rotation drive of the drive member 98 can thus be favorably transmitted to the left flange member 55.

(3) Each slide member 70 has the opening 71 in its center. When the reciprocation member 101 and the left bearing fitting part 59 are connected, the protrusion 63 passes through the opening 71 and makes contact with the contact wall 114. Such a simple configuration can reliably prevent the urging force of the spring member 99 from acting on the slide member 70, so that the urging force can act on the left bearing fitting part 59 directly from the reciprocation member 101.

(4) The reciprocation members 101 can be moved by the interlocking mechanism 202 between the advanced position and the retracted position. The reciprocation members 101 and the left bearing fitting parts 59 can thus be connected and separated as appropriate.

(5) Each photosensitive drum 14 has the left flange member 55 at the left end and the right flange member 56 at the right end. The right end of the right bearing fitting part 61 of the right flange member 56 is formed as the sliding part 67. When the driving force from the drive source 200 and the urging force from the spring member 99 act on the left flange member 55, the sliding part 67 slides over the inside surface of the sealing part 90 of the right bearing member 81 supported by the process frame 15 as the photosensitive drum 14 is driven to rotate. The rotation drive of the photosensitive drum 14 can be controlled by adjusting the urging force of the spring member 99 and the driving force of the drive source.

(6) When the process frame 15 is mounted in the main casing 2 and the reciprocation members 101 are placed in the advanced position, the contact walls 114 make contact with the protrusions 63. The urging force of the spring members 99 then acts on the process frame 15 through the photosensitive drums 14. The process frame 15 is thereby positioned with respect to the main casing 2 in the lateral direction (the axial direction of the photosensitive drums 14). In other words, the photosensitive drums 14 are positioned with respect to the main casing 2 in the lateral direction. More specifically, the process frame 15 (photosensitive drums 14) is positioned with respect to the main casing 2 by the urging force acting on the left bearing fitting parts 59 of the photosensitive drums 14 from the left. Such a simple configuration can improve the positioning accuracy of the process frame 15 (photosensitive drums 14) with respect to the main casing 2.

7. Modification

Next, a second embodiment of the present invention will be described.

Figure 11:
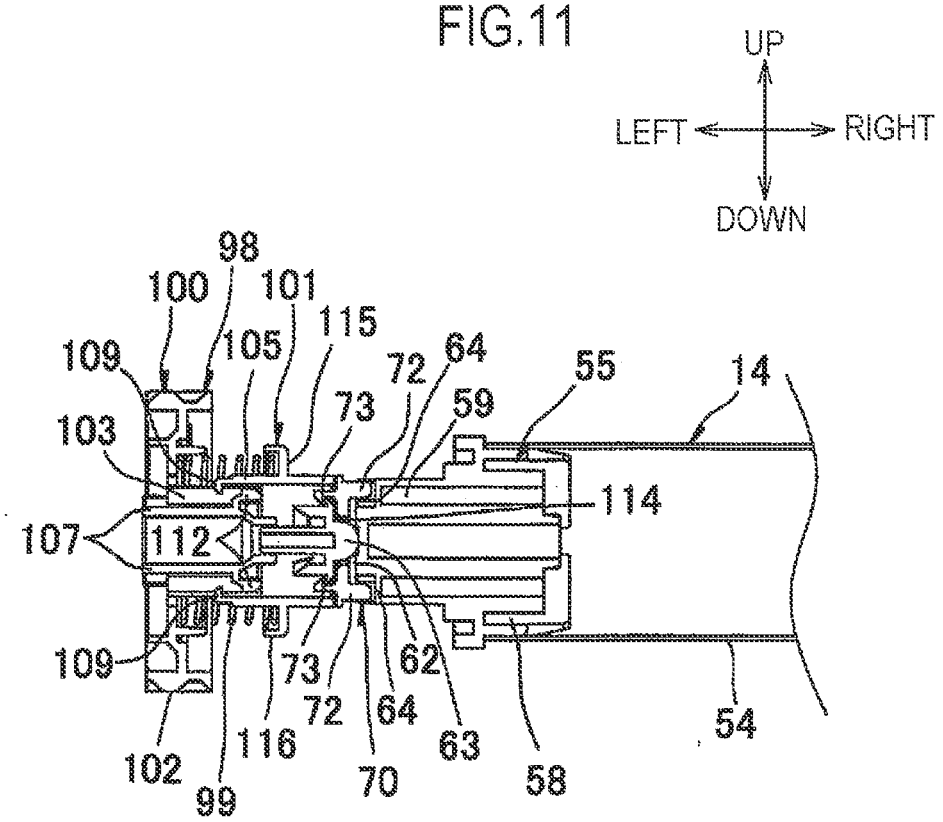
FIG. 11 is a cross-sectional view illustrating an Oldham coupling according to a second embodiment of the present invention.

FIG. 11 is a cross-sectional view illustrating an Oldham coupling in a color laser printer according the second embodiment of the present invention.

In FIG. 11, parts corresponding to those illustrated in FIGS. 1 to 10 are designated by the same reference numerals. Description thereof will be omitted.

In the first embodiment, as illustrated in FIG. 9, the slide member 70 is supported by the left flange member 55. The protrusion 63 is formed on the sealing wall 62 of the left bearing fitting part 59.

In the second embodiment of the present invention, as illustrated in FIG. 11, the slide member 70 is supported by the reciprocation member 101. The protrusion 63 is formed on the center area of the contact wall 114 of the reciprocation member 101.

Specifically, the sealing wall 62 of the left bearing fitting part 59 has no protrusion 63 and has no engagement through-hole 65. The protrusion 63 is formed on the contact wall 114 of the reciprocation member 101. The engagement through-holes 65 are also formed in the contact wall 114.

On the contact wall 114, the main casing side coupling fitting through-holes 117 and the engagement through-holes 65 are arranged at regular intervals in the circumferential direction, with a shift of approximately 90 degrees from each other.

In the first embodiment, as illustrated in FIGS. 3 and 4, the slide member 70 is oriented such that the surface formed with the latch protrusions 73 confronts to the right. However, according to the present embodiment, the slide member 70 is turned over so that the surface formed with the latch protrusions 73 confronts to the left.

The latch protrusions 73 now formed on the left side surface of the slide member 70 are inserted through the respective engagement through-holes 65 of the reciprocation member 101. The hook-like portions 74 of the latch protrusions 73 are engaged with the inside surface (left side surface) of the contact wall 114. In such a manner, the slide member 70 is supported by the reciprocation member 101.

The protrusion 63 of the reciprocation member 101 is inserted through the opening 71 of the slide member 70, and protrudes to the right from the slide member 70.

The lateral length from the bottoms of the latch protrusions 73 to the left end faces of the hook-like portions 74 is greater than the thickness of the contact wall 114. The slide member 70 can make a movement in the lateral direction. The opening 71 has a diameter greater than that of the circumferential outline of the protrusion 63 when seen in a lateral projection.

When the reciprocation member 101, the slide member 70, and the left bearing fitting part 59 constitute an Oldham coupling, the protrusion 63 of the reciprocation member 101 comes into contact with the sealing wall 62 of the left bearing fitting part 59.

While the invention has been described in detail with reference to the embodiments thereof, it would be apparent to those skilled in the art that various changes and modifications may be made therein without departing from the spirit of the invention.

For example, in the embodiments, a plurality of photosensitive drums 14 is mounted in the process unit 9. However, only one photosensitive drum 14 may be mounted in the process unit 9.

What is claimed is:

1. An image forming apparatus, comprising:

a drive source that is configured to generate drive force;

a drive member that is configured to receive drive force transmitted from the drive source and to be driven to rotate upon receiving the drive force, the drive member having a drive-member side contact part;

a rotating body that has a follower member, the follower member being arranged to confront the drive member in an axial direction of the drive member, the follower member having a follower-member side contact part;

an urging member that is configured to urge the drive member to the follower member to maintain direct contact between the drive-member side contact part of the drive member and the follower-member side contact part of the follower member; and a movable drive transmitting member that is formed with an opening to allow the drive member and the follower member to be in direct contact with each other, configured to transmit drive force from the drive member to the follower member by coupling the drive member and the follower member with each other, and movably disposed such that the movable drive transmitting member moves relative to the drive member and the follower member on a plane perpendicular to the axial direction of the drive member when the drive-member side contact part and the follower-member side contact part are in direct contact with each other.

2. The image forming apparatus as claimed in claim 1, wherein either one of the drive-member side contact part and the follower-member side contact part has a protrusion which is inserted through the opening of the movable drive transmitting member, the opening having a size that is greater than that of a circumferential outline of the protrusion to allow the movable drive transmitting member to move relative to the drive member and the follower member on the plane perpendicular to the axial direction of the drive member when the protrusion is in direct contact with the other one of the drive-member side contact part and the follower-member side contact part.

3. The image forming apparatus as claimed in claim 1, wherein the drive member includes a reciprocation member that is configured to move between an advanced position, in which the reciprocation member is coupled with the follower member through the movable drive transmitting member, and a retracted position, in which the reciprocation member is not coupled with the follower member.

4. The image forming apparatus as claimed in claim 1, further comprising:

an apparatus main body; and a support member that is configured to rotatably support a pair of opposed axial ends of the rotating body and that is configured to be mounted in and detached from the apparatus main body, the rotating body has the follower member at one of the pair of opposed axial ends, and has a sliding part at the other one of the pair of opposed axial ends, the sliding part being configured to rotate relative to the support member and to slide against the support member.

5. The image forming apparatus as claimed in claim 4, wherein the support member is configured to support the follower member such that the follower member is rotatable relative to the support member, but is non-movable relative to the support member in an axial direction of the rotating body, to allow the urging member to position the rotating body and the support member relative to the apparatus main body in the axial direction of the rotating body by maintaining the direct contact between the drive-member side contact part of the drive member and the follower-member side contact part of the follower member.

6. The image forming apparatus as claimed in claim 1, wherein the movable drive transmitting member is configured such that when the drive-member side contact part and the follower-member side contact part are in direct contact with each other, the movable drive transmitting member is movable relative to the drive member and the follower member in the axial direction of the drive member at a position between the drive member and the follower member in the axial direction of the drive member.

7. A rotating body unit for being mounted in an apparatus main body, the apparatus main body being provided with a drive source that is configured to generate drive force and a drive member that is configured to receive drive force transmitted from the drive source and to be driven to rotate upon receiving the drive force, the drive member having a drive-member side contact part, the rotating body unit comprising;

a rotating body that has a follower member, the follower member being arranged to confront the drive member in an axial direction of the drive member if the rotating body unit is mounted in the apparatus main body, the follower member having a follower-member side contact part; and a movable drive transmitting member that is formed with an opening to allow the follower-member side contact part of the follower member to be in direct contact with the drive-member side contact part of the drive member, the direct contact of the follower-member side contact part with the drive-member side contact part being maintained due to an urging force generated by an urging member that is provided in the apparatus main body, the movable drive transmitting member being configured to transmit drive force from the drive member to the follower member by coupling the drive member and the follower member with each other, and being movably disposed such that the movable drive transmitting member moves relative to the drive member and the follower member on a plane perpendicular to the axial direction of the drive member when the follower-member side contact part is in direct contact with the drive-member side contact part.

8. The rotating body unit as claimed in claim 7, wherein the follower-member side contact part has a protrusion.

9. The rotating body unit as claimed in claim 8, wherein the protrusion is inserted through the opening of the movable drive transmitting member, the opening having a size that is greater than that of a circumferential outline of the protrusion; to allow the movable drive transmitting member to move relative to the drive member and the follower member on the plane perpendicular to the axial direction of the drive member when the protrusion is in direct contact with the drive-member side contact part.

10. The rotating body unit as claimed in claim 7, wherein the movable drive transmitting member is configured such that when the follower-member side contact part is in direct contact with the drive-member side contact part, the movable drive transmitting member is movable relative to the drive member and the follower member in the axial direction of the drive member at a position between the drive member and the follower member in the axial direction of the drive member.

* * * * *